US008384540B2

(12) United States Patent
Reyes et al.

(10) Patent No.: US 8,384,540 B2
(45) Date of Patent: Feb. 26, 2013

(54) SYSTEMS AND METHODS FOR DETECTING AND GEO-LOCATING HAZARDOUS REFUSE

(75) Inventors: Hector M. Reyes, Richardson, TX (US); Donald P. Graham, Allen, TX (US); Mary J. Hewitt, Santa Barbara, CA (US); Michael Crist, Anna, TX (US)

(73) Assignee: Raytheon Company, Waltham, MA (US)

( * ) Notice: Subject to any disclaimer, the term of this patent is extended or adjusted under 35 U.S.C. 154(b) by 395 days.

(21) Appl. No.: 12/824,641

(22) Filed: Jun. 28, 2010

(65) Prior Publication Data

US 2011/0316689 A1 Dec. 29, 2011

(51) Int. Cl.
*G08B 1/00* (2006.01)

(52) U.S. Cl. ..... 340/532; 340/572.1; 340/539.13; 209/3.2

(58) Field of Classification Search .... 340/572.1–572.9, 340/10.1–10.5; 235/375–385; 241/24.1, 241/63, 81; 414/21, 408, 409; 209/3.3, 583, 209/589

See application file for complete search history.

(56) References Cited

U.S. PATENT DOCUMENTS

| | | | | |
|---|---|---|---|---|
| 5,014,206 | A * | 5/1991 | Scribner et al. | 701/517 |
| 5,842,652 | A * | 12/1998 | Warsing et al. | 241/81 |
| 2003/0112155 | A1 * | 6/2003 | Landre et al. | 340/988 |
| 2005/0131645 | A1 * | 6/2005 | Panopoulos | 701/214 |
| 2007/0225991 | A1 * | 9/2007 | Hollingsworth et al. | 705/1 |
| 2008/0029439 | A1 * | 2/2008 | Mallett et al. | 209/3.3 |
| 2008/0061977 | A1 * | 3/2008 | Maruca et al. | 340/572.1 |
| 2009/0004051 | A1 * | 1/2009 | Firestone et al. | 422/28 |
| 2009/0032442 | A1 * | 2/2009 | Singh et al. | 209/12.1 |
| 2011/0060451 | A1 * | 3/2011 | Borowski et al. | 700/224 |

FOREIGN PATENT DOCUMENTS

WO WO 2006/111969 10/2006

* cited by examiner

*Primary Examiner* — Hai Phan
*Assistant Examiner* — Ojiako Nwugo

(57) ABSTRACT

The present disclosure relates to systems and methods for scanning refuse (garbage, trash) from a large geographic area to detect the presence of hazardous materials in the refuse. Hazardous material may comprise CBRNE agents, components of terrorist devices, environmental pollutants and toxins and illegal drugs and may include trace particulates of such agents as well as by-products thereof. Systems and methods, according to some embodiments, may further comprise geo-locating to a small geographic area the origin of hazardous material. Accordingly, in some embodiments the disclosure provides systems and methods to geo-locate facilities or addresses where hazardous materials are generated, thereby geo-locating facilities that make terrorist devices, sources of environmental pollutants and/or sources of illegal drugs. According to some embodiments, systems and methods of the disclosure enable focusing efforts of law enforcement authorities to identify terrorists, drug activities and/or environmental offenders to small geographic areas (e.g. a street address).

28 Claims, 6 Drawing Sheets

SYSTEMS AND METHODS FOR DETECTING AND GEO-LOCATING HAZARDOUS REFUSE

FIELD OF THE DISCLOSURE

The present disclosure relates, in some embodiments, to systems and methods operable to detect a hazardous material (e.g., explosive agent, hazardous chemical agent, toxic biological agent, nuclear or radioactive agent, pollutants, or drugs) in discarded waste materials and to geographically locate the origin of waste material containing a hazardous material, i.e., locate a source generating a hazardous material. Accordingly, in some embodiments, the present disclosure relates to systems and methods to geo-locate an address or a facility where hazardous materials are generated such as but not limited to a facility to manufacture explosive devices, chemical and/or biological warfare agents, a facility that manufactures or supplies drugs and/or individuals or facilities that dispose toxic materials into garbage.

BACKGROUND OF THE DISCLOSURE

Present technology is focused on devices and methods for detecting explosive devices, chemical agents and/or biological agents used by terrorists after they are made and when they are brought into public places. For example, most public facilities that are targets for terrorist attacks, such as airports, government buildings and museums are equipped with detectors operable to detect concealed explosive devices, guns and other terrorist devices. However, these detectors detect threats after the threat is put into operation and close to being carried out. Any failure in detection results loss of life and trauma from a successful terrorist attack.

Present technology also lacks effective methods to geo-locate environmental violators such as individuals or factories that generate and dispose toxic environmental wastes into the environment. Solvents, paints, batteries, industrial effluents, chemicals, heavy metals and the like are often disposed into garbage rather than being taken to facilities where they may be subject to decontamination prior to disposal. However, there is no effective technology to geo-locate the source of such environmental pollutants and/or to identify environmental violators to prevent further violations.

Law enforcement personnel also find it difficult to locate manufacturers and suppliers of addictive substances such as illegal drugs. Many illegal drug dealers have their supply/manufacture operations in houses or apartments in neighborhoods and there are no available effective methods for screening for and locating such facilities.

SUMMARY

The present disclosure, according to some embodiments, provides systems and methods for scanning a large geographic region, such as but not limited to a city, a town, a village, a rural area, or parts thereof, on a regular basis for detecting and identifying smaller geographic areas where individuals or terrorists make devices used in terrorist activities. According to some embodiments, systems and methods of the present disclosure may be designed to scan for and detect hazardous materials associated with terrorist devices or byproducts thereof that end up as waste material by scanning refuse, garbage and/or trash generated from a large geographic area and correlating the detection of an identified hazardous material with a smaller geographic area where such devices may be manufactured.

Accordingly, systems and methods of the disclosure may scan refuse to detect hazardous materials and in some embodiments, to further geo-locate where the detected hazardous material originated, thereby geo-locating an address or a facility that may be developing or manufacturing a terrorist device. Individuals associated with the address or facility may be then investigated by law enforcement authorities to find terrorists such as bomb-makers and prevent the occurrence of a terrorist activity.

In some embodiments, systems and methods of the disclosure may be used for scanning a geographic region on a regular basis for detecting and identifying geo-locations of individuals or facilities that dispose toxic materials illegally into regular refuse. According to some embodiments, systems and methods of the present disclosure may be designed to scan waste material (refuse, garbage and/or trash) to detect hazardous materials associated with environmental pollutants or byproducts thereof and to geo-locate the source of origin of the environmental pollutant.

Individuals associated with an address or facility may be then be investigated by environmental enforcement authorities to find environmental violators and prevent the occurrence of further environmental violations.

In some embodiments, systems and methods of the disclosure may be used for scanning refuse (garbage and/or trash) from a geographic region on a regular basis for detecting and identifying hazardous materials such as illegal drugs or byproducts thereof and to geo-locating individuals and/or facilities that manufacture and/or supply illegal drugs.

Individuals associated with an address or facility manufacturing or supplying illegal drugs may be then be investigated by law enforcement authorities and reduce and prevent further drug dealing and manufacturing activities.

Systems and methods of the disclosure may utilize existing infrastructure, such as waste collection systems and waste management plants for detecting hazardous materials or byproducts thereof in refuse. Further details regarding systems and methods of the disclosure are provided in the detailed description.

Some embodiments of the disclosure may provide one or more of the following technical advantages. A technical advantage of some embodiments may include the ability of present systems and methods to scan refuse collected from a large geographic area on a regular basis to detect hazardous material associated with terrorist activities and/or environmental violation activities and/or illegal drug manufacturing, drug supplying, drug dealing and/or drug smuggling activities and correlating the detected hazardous material to a smaller geographic area thereby locating the source and/or reducing the geographic area of a potential source of such activities.

A technical advantage of some embodiments may include the ability of present methods and systems to scan a large geographic area and identify a small geographic area of origin of hazardous materials by utilizing existing infrastructure of waste management facilities, thereby minimizing cost.

A technical advantage of some embodiments may include the ability of the present methods and systems to save lives by geo-locating a facility for making terrorist devices based on waste material generated from such a facility (e.g., locating a bomb-maker rather than a bomb would result in early intervention and prevention of terrorist activity).

A technical advantage of some embodiments may include ability of present systems and methods to detect a geographic source of origin of a hazardous material (related to a terrorist device, an environmental pollutant and/or an illegal drug) to a geographic region of about six square miles or less. A technical advantage of some embodiments may include ability of present systems and methods to pinpoint a street address as a geographic source of origin of a hazardous material.

A technical advantage of some embodiments may include the ability of present systems and methods to detect a hazardous material at a sensitivity of about one (1) pg/cm$^2$. A technical advantage of some embodiments may include the ability of present systems and methods to scan refuse collected by a waste management system at a throughput rate of one thousand (1000) tons/day to detect a hazardous material.

Further technical advantages of particular embodiments of the present disclosure may include the ability to automatically send a detection alert to a remote data center or a command center. A technical advantage of particular embodiments may include the ability to automatically notify law enforcement personnel when a positive detection of a hazardous material is made. In some embodiments, a detection alert (to a remote command center or to law enforcement) may include a precise street address where hazardous material was collected from. In some embodiments, locating a precise street address may be facilitated by locating sensor technologies at garbage collection points.

Various embodiments of the disclosure may include none, some, or all of the above technical advantages. One or more other technical advantages may be readily apparent to one skilled in the art from the figures, descriptions, and claims included herein.

This summary contains only a limited number of examples of various embodiments and features of the present disclosure. For a better understanding of the disclosure and its advantages, reference may be made to the description of exemplary embodiments that follows.

BRIEF DESCRIPTION OF THE DRAWINGS

Some embodiments of the disclosure may be understood by referring, in part, to the present disclosure and the accompanying drawings, wherein.

DETAILED DESCRIPTION

It should be understood at the outset that, although example implementations of embodiments of the disclosure are illustrated below, embodiments of the present disclosure may be implemented using any number of techniques, whether currently known or not. The present disclosure should in no way be limited to the example implementations, drawings, and techniques illustrated below. Some embodiments of the disclosure and associated advantages may be best understood by reference to FIGS. 1A-4 wherein like numbers refer to same and like parts.

Figure 1A:
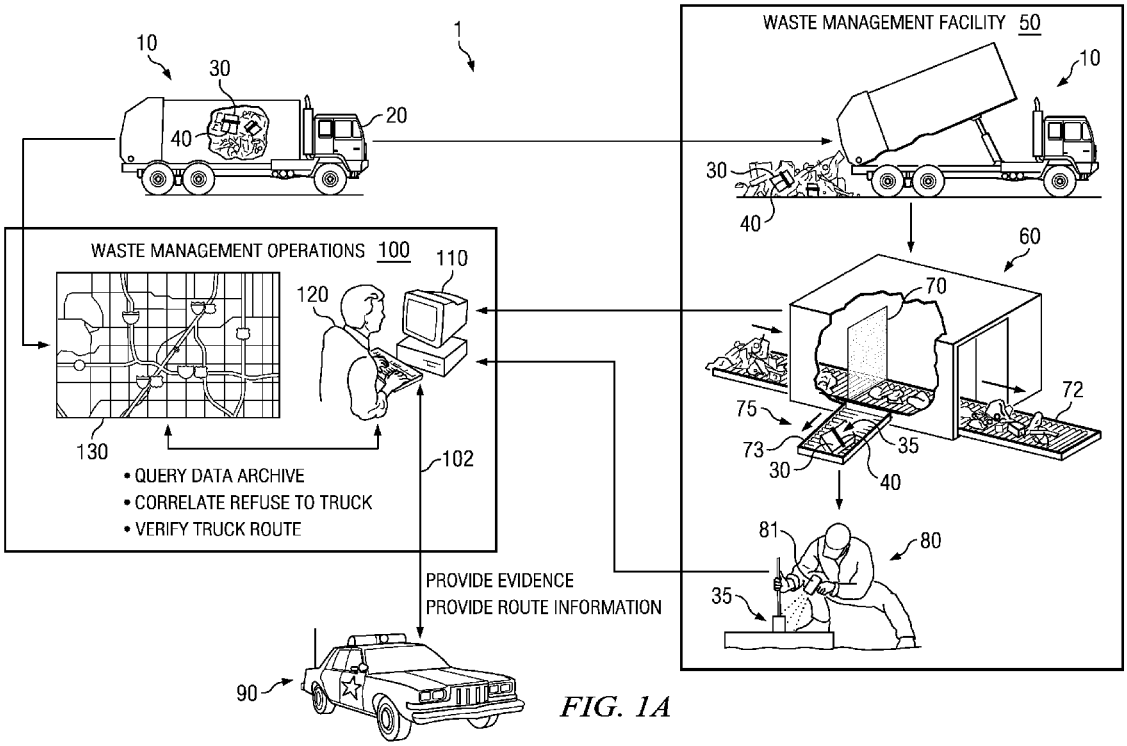
FIG. 1A illustrates an exemplary system operable to scan, detect and geo-locate a hazardous material in refuse, according to a specific example embodiment of the disclosure.
Figure 1B:
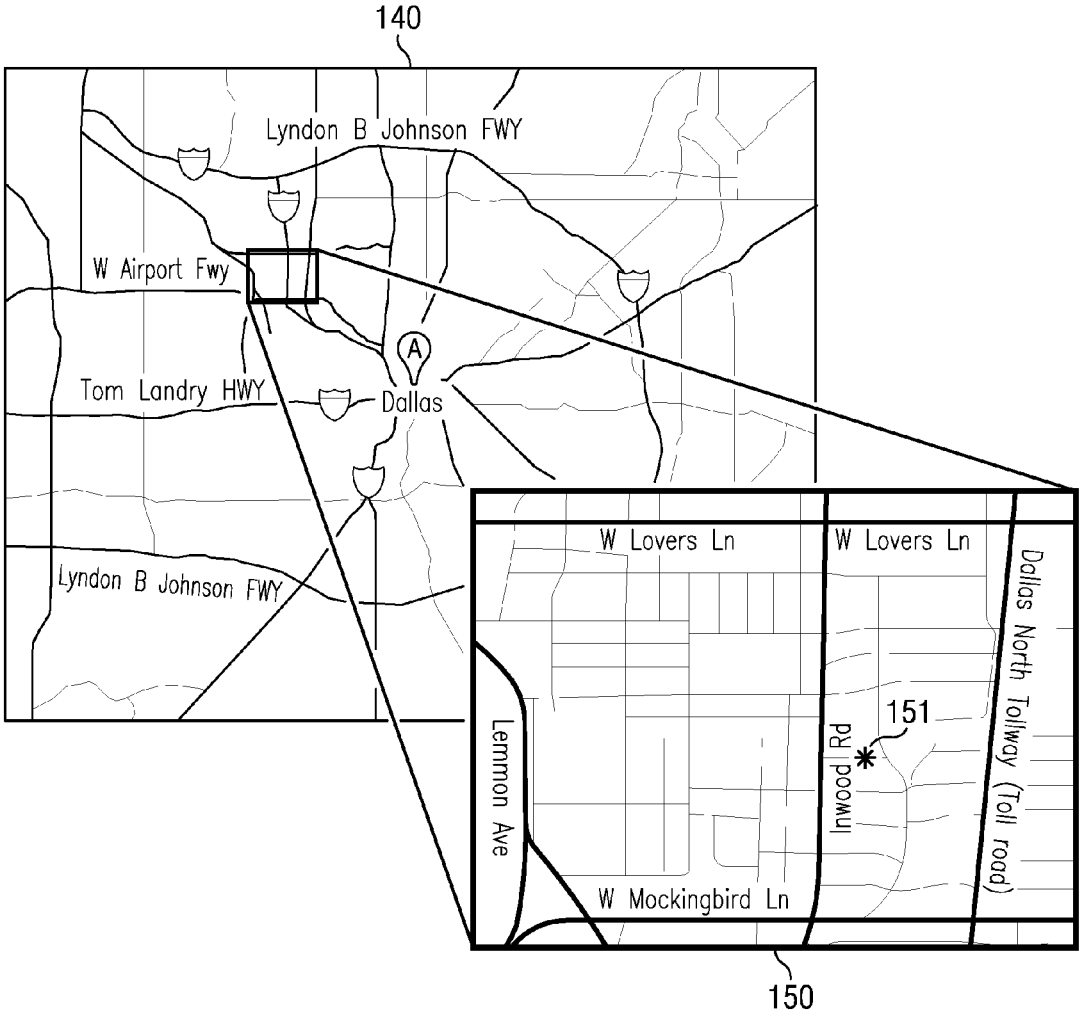
FIG. 1B illustrates an exemplary large geographic area that may be scanned for the presence of a hazardous material in refuse (garbage), an exemplary small geographic area where the detected hazardous material may be geo-located to, and/or an exemplary street address where a detected hazardous material may be geo-located to by systems and methods, according to various example embodiments of the disclosure.

FIG. 1A illustrates an exemplary system 1, according to some embodiments of the disclosure, operable to scan large geographic region 140 (shown in FIG. 1B), such as but not limited to a city, town, village, rural area, suburb or neighborhood, to detect for the presence of one or more hazardous materials 35. Components of system 1 may be further operable to geo-locate the source of hazardous material 35 to small geographic area 150 (shown in FIG. 1B) or a street address 151 (shown in FIG. 1B). Components of system 1 may be operable to identify a location or a facility in small geographic area 150 (or 151) that is the source of hazardous material 35. While FIG. 1B depicts large geographic area as a part of a town, teachings recognize that the disclosure is not limited to the depiction and any large geographic area may be scanned, in accordance to the present teachings.

Teachings recognize that the disclosure is not limited to system 1 as depicted in FIG. 1A and other alternative components, designs, including the presence of additional or fewer components may be used in accordance to the present teachings.

In some embodiments, a hazardous material 35 that may be scanned for and detected by system 1 (and by system 2 and methods of the present disclosure which are described later) may include agents that may be associated with and/or comprised in terrorist devices, such as but not limited to explosive devices, chemical warfare devices, bio-terrorist weapons/agents, radioactive/nuclear devices; agents that may be environmental pollutants such as but not limited to a toxic chemical, a heavy metal, a solvent, a paint, a battery, a biohazardous material; agents that may be comprised in illegal drugs. A hazardous material may also include byproducts of any of the categories of hazardous materials described above that may be formed while decomposition, decay, incineration of, or reaction of a hazardous material with air or other components of trash.

In some examples, non-limiting examples of hazardous materials associated with terrorist devices may include one or more of the following agents: a chemical agent, a biological agent, a radioactive agent, a nuclear agent or an explosive agent (also referred to collectively as CBRNE agents). Non-limiting examples of CBRNE agents may include components or chemicals comprised in an explosive device, a chemical warfare agent, a radioactive material, a nuclear agent, a biological toxin, a disease causing bacteria, a virus, a pathogenic spore, a bio-terrorist agent, and/or any combinations thereof.

Example explosive devices may include car-bombs, homemade bombs, land mines, improvised explosive devices (IEDs), explosively formed penetrators (EFPs). Examples of chemical components that may be associated with or comprised in an explosive device that may be detected as hazardous material 35, according to embodiments of the present disclosure, may include but are not limited to, trinitrotoluene (TNT), cyclotrimethylenetrinitramine (RDX), pentaerythrite tetranitrate (PETN), dynamite, ammonium nitrate and fuel oil (ANFO), amatol, ammonium nitrate, ammonium picrate, dynamite, guanidine nitrate, gunpowder, high melting explosive (HMX), hexanitrostilbene, lead azide, lead styphnate, mannitol hexanitrate, mercury fulminate, naphthacene, nitroglycerine, nitroguanidine, a plastic bonded explosive and/or a polymer bonded explosive (a PBX explosive), pentaerythritol, tetranitrate, picric acid, Triacetone Triperoxide (TATP)

also referred to as peroxyacetone, triaminotriniotrobenzene, tritonal, and/or byproducts or combinations thereof.

Other exemplary chemical agents associated with terrorist devices that may be detected as hazardous material 35 according to the present disclosure may include, chemical warfare agents such as but not limited to, nerve agents such as but not limited to: Tabun, Sarin, Soman, VX; mustard, lewisite, phosgene, chlorine, ammonia, cyanide, Mace®, pepper spray, vesicants, riot control agents.

Exemplary biological agents that may be associated with terrorist devices and may be detected as hazardous material 35 according to the present disclosure may include but are not limited to, harmful bacteria, bacterial spores, viruses, fungi, bacterial and fungal toxins, cytotoxins, neurotoxins, including genetic variants thereof that may be more virulent, harder to treat, or more toxic. Some non-limiting examples of bacteria that may be used in biological warfare include *Bacillus anthracis, Yersinia pestis, Francisella tularensis, Vibrio cholerae, Clostridium botulinum, Chlamydia psittaci, Shigella dysenteriae, Staphylococcus aureus, Burkholderia mallei*, and *Salmonella typhi*, that may cause diseases such as anthrax, plague, tularemia, cholera, typhoid, and Q-fever. Exemplary viruses may include, Variola virus, Venezuelan equine encephalitis virus, dengue virus, hantavirus, Marburg virus, Ebola virus, Crimean Congo hemorrhagic fever virus, and arena viruses.

Examples of radioactive materials that may be detected as hazardous material 35 according to the present disclosure include but are not limited to, components of nuclear weapons include Uranium-235 ($U^{235}$) and/or Plutonium-239 ($Pu^{239}$) both of which may facilitate an explosion or an explosive chain reaction and may release lethal radioactivity.

Examples of chemical agents that may be associated with environmental pollution may include but are not limited to paints which may comprise hazardous materials such as but not limited to volatile organic compounds (VOC's), colorants, heavy metal, pigments; solvents such as but not limited to acetone, formaldehyde, benzene (benzol), methyl alcohol (methanol); adhesives; industrial chemicals such as but not limited to heavy metals, nitrogen dioxide ($NO_2$), sulfur dioxide ($SO_2$), carbon monoxide (CO), chlorofluorocarbons (CFCs); chemicals present in batteries such as but not limited to cadmium, lithium, mercury, nickel, lead and acids; pesticides such as chlorpyrifos, paraquat, and their byproducts, such as dioxin.

Examples of hazardous materials comprised in illegal drugs may include without limitation methylenedioxymethamphetamine (MDMA), rohypnol (flunitrazepam), GHB (gamma hydroxybutyrate), ketamine (ketamine hydrochloride), cocaine, lysergic acid diethylamide (LSD), mescaline, psilocybin/psilocin, heroin, marijuana, methamphetamine and analogs and byproducts thereof.

As shown in FIG. 1A, according to some embodiments, system 1 of the disclosure may comprise a plurality of refuse collection vehicles, depicted as trucks 10, each truck 10 operable to collect refuse 30. Trucks 10 may be part of an existing infrastructure such as a garbage collection facility or a waste management facility and may be a refuse collection truck. The present disclosure is however not limited to a refuse collection truck 10 and any vehicle or equipment designed to collect refuse, trash or garbage from a geographic location such as but not limited to trash trucks, recycle vehicles and the like may be used in accordance with the present teachings. In some embodiments, refuse includes materials disposed as garbage or trash and may not include sewage wastes.

In some embodiments, each truck 10 may have geo-location system 20 operable to track and store a plurality of routes 130 taken by each truck 10. Geo-location system 20 may comprise a global satellite positioning system (GPS), a vehicle navigation system and/or any navigation system operable to track and store one or more routes 130 travelled by truck 10 while collecting refuse 30 from an area such as large geographic area 140 or a portion thereof.

Route 130 may comprise one or more roads travelled by truck 10 and may be depicted and/or stored as a road map. In some embodiments, route 130 may also comprise stop times and may include street addresses including information about stop duration and frequency at each address/location of refuse pickup.

Each truck 10 may have a device (not depicted) for attaching at least one tag 40 to collected refuse 30. A device for attaching tag 40 may comprise a machine or may comprise manual attachment (such as by a human operator) of tag 40.

Tag 40 may be operable to associate collected refuse 30 to a respective truck 10. Tag 40, in some embodiments, may be operable to associate collected refuse 30 to a respective geo-location.

In some embodiments, tag 40 may be a geo-location tag, a radio frequency (RF) tag, a dye, a barcode, a paint, a chemical whose properties allow easy detection by a sensor or scanner, and/or any combinations thereof. A geo-location tag 40 may comprise and/or correspond to one or more of the following data such as but not limited to: identity of truck 10, a street address, a subdivision address, a route, and/or a geographic location. A dye tag 40 may comprise marking refuse 30 collected by a truck 10 with one or more colored dyes. In some embodiments, dye tag 40 may comprise marking refuse 30 collected by truck 10 from different geographic locations with different colors. For example, all refuse 30 picked up on one street may have a first color tag 40*a* associated with it, or all refuse 30 collected by truck 10 in one subdivision may have a respective color tag 40*b* associated with it.

In some embodiments, system 1 may be operable to attach tag 40 onto each bag of refuse 30 collected. In some embodiments, a first tag 40*a* may be attached to all refuse 30 collected from a street address 151*a*, a second tag 40*b* may be attached to all refuse collected from a second street address 151*b* and so on. In some embodiments, a first tag 40*a* may be attached to all refuse 30 collected from a first smaller geographic area 150*a*, a second tag 40*b* may be attached to all refuse 30 collected from a second smaller geographic area 150*b*.

System 1 may comprise scanning system 60 operable to scan collected refuse 30 and further operable to detect presence of hazardous material 35 in collected refuse 30. Scanning system 60 may comprise scanner 70 operable to detect hazardous material 35.

In some embodiments, scanning system 60 comprising scanner 70 may be located on truck 10 (not expressly depicted in FIG. 1A). In some embodiments, scanning system 60 may be located at waste management facility 50.

In some embodiments, scanning system 60 may comprise a device (not expressly shown) to expose (crush, cut, open or break) the contents of concealed hazardous material 35 that may be concealed inside plastic bags, boxes or other container means to prevent detection, prior to scanning. A device to expose contents of concealed hazardous material may include a manual operator.

In some embodiments, scanning system 60 may comprise an identification system comprising a tag reader (not expressly depicted) operable read tag 40 attached to refuse 30. Scanning system 60 may comprise a tag reader that may be operable to read tag 40 prior to, during, and/or following scanning.

In some embodiments, as shown in FIG. 1A, scanning system 60 may comprise conveyor belt 72 onto which refuse 30 to be scanned may be deposited. In some embodiments, scanning system 60 may comprise manual scanning of refuse 30 (not expressly depicted). Teachings recognize that the disclosure is not limited to any particular configuration or type of scanning system 60 and/or scanner 70 to scan refuse 30 and any system operable to scan a large throughput of refuse may be used. Teachings also recognize that scanning system 60 may be located at a variety of locations, such as but not limited to, on a refuse collection vehicle (e.g., truck 10), at a garbage transfer station, a waste management facility, a landfill and the disclosure is not limited by the location of scanning system 60 and scanner 70.

Scanner 70 may comprise one or more commercial off the shelf (COTS) scanners operable to scan for and detect the presence of hazardous material 35. An exemplary scanner 70 may comprises a spectrophotometer, an X-ray imager, a imaging system, an electrochemical system, a vapor sensor, a laser sensor, a visual sensor, a surface acoustic wave sensor (SAWS), a mass sensors, an optical sensor, a Compton imager, a stand-off radiation detection system (SORDS), a photon detector, a Geiger counter, a scintillation counter, a biological assay, a nucleic acid detection and analysis system, a protein detection and/or analysis system, an immunoassay, an enzymatic assay, a data collection module, a data processing module, a module to detect and subtract background noise, a module operable to store collected data, an identification module, an output module, an alarm module and any combinations thereof. Exemplary spectrophotometers may include but are not limited to a mass spectrometry system (MS), a gas chromatography (GC) spectrophotometer, a Raman spectrophotometer. In some embodiments, scanner 70 may have high sensitivity of detection and may also have components to reduce or subtract background noise of other materials that may comprise refuse 30.

In some embodiments, system 1 may comprise multiple types of scanners 70 (chemical scanners, biological scanners, radiation scanners) to allow for scanning of a variety of hazardous materials. In some embodiments, multiple types of scanners 70 (chemical scanners, biological scanners, radiation scanners) may be integrated into a bigger scanner unit operable for scanning of a variety of hazardous materials. In some embodiments, system 1 may comprise multiple scanning systems 60 to achieve a throughput rate sufficient for scanning all refuse collected from a city or town.

System 1 may comprise isolation system 75 operable to separate and isolate refuse 30 detected to have hazardous material 35. Isolation system 75, according to some embodiments, may comprise conveyor belt 73 on which refuse 30 detected to have hazardous material 35 may be directed to for isolation and/or quarantine. Teachings recognize that isolation system 75 may comprise other modes by which refuse 30 detected to have hazardous material 35 may be isolated or separated from the remaining refuse. In some embodiments, a manual isolation system or a combination of manual and automated isolation system may be used.

Isolation system 75 may comprise an identification system (not expressly depicted) operable read tag 40 attached to refuse detected to have hazardous material 35. Isolation system 75 comprising an identification system may be further operable to identify truck 10 that collected refuse detected to have hazardous material 35. In some embodiments, isolation system 75 comprising an identification system may further be operable to obtain route 130 taken by truck 10 that collected refuse detected to have hazardous material 35.

System 1 may comprise scanner 80 operable to rescan and confirm detection of hazardous material 35. In some embodiments, scanner 80 may comprise a human operator and a scanner 81 as shown. In some embodiments, scanner 80 may comprise an automated scanner operable to scan isolated refuse detected to have hazardous material 35 (not expressly depicted).

System 1 may comprises notification system 102 operable to notify authorities 90 (e.g., law enforcement personnel such as police, drug enforcement authorities, Type I Bomb Squads, environmental regulation authorities, drug enforcement personnel) about refuse 30 detected to have hazardous material 35 and associated route 130 taken by truck 10 that collected the refuse 30 detected to have hazardous material 35.

System 1 may comprise waste management operations 100 which may comprise without limitation one or more of the following components, a device to receive and a storage means (e.g., a database) to store, various routes 130 taken by various trucks 10; a means to communicate with waste management facility 50 to receive data such as a positive detection of hazardous material 35; and/or no detection of hazardous material; and/or isolation of detected hazardous material 35; at least a means to query (e.g., a software) a storage means (such as a database) about a respective route 130 taken by a respective truck 10; at least a means to correlate (e.g., software) refuse 30 detected to have hazardous material 35 by reading an associated tag 40 to a truck 10; means to verify a truck route 130; personnel to operate, read, interpret and respond to various inputs received; means to send information (e.g., notification means 102) about detected hazardous material and associate route information to authorities 90 (e.g., law enforcement personnel, environmental enforcement personnel); and a means to communicate with and provide additional route or hazardous material information to authorities 90.

Accordingly, waste management operations 100 may comprise one or more of the following devices that have not been expressly depicted including: one or more computers, personnel, storage devices, input devices, communication devices, devices to receive information, devices to send information, one or more process control programs, one or more data input programs, one or more data output readers, software to analyze information received, a network interface (or network connectivity), printing devices, visual graphics display devices (such as a video wall). In some embodiments, system 1 may be started, shut down and controlled in manually, automatically or by a combination of automated and manual steps. Manual control may be by human operators.

In an exemplary embodiment, system 1 may function by a plurality of trucks 10 driving a plurality of routes 130, covering a large geographic area 140, to collect refuse 30 at various locations (e.g., addresses) on each route 130. Routes 130 taken by each truck 10 may be recorded and stored by geo-location system 20. Routes 130 taken by each truck 10 may also be transmitted and stored in a database comprised in waste management operation facility 100.

Refuse 30 picked up by truck 10 may be tagged by tag 40. Each tag 40 may be operable to identify a respective truck 10 and the refuse 30 that was picked up by the respective truck. In some embodiments, each tag 40 may be operable to identify refuse with a respective location and/or route 130 from where it was picked up. In some embodiments, a location may be a subdivision. In some embodiments, a location may be a neighborhood. In some embodiments, a location may be a street. In some embodiments, a location may be a street address 151. Accordingly, in some embodiments, refuse 30 collected from a first location (geo-location) may be tagged with a first tag 40*a*, refuse 30 collected from a second location may be tagged with a second tag 40*b* and the process repeated with different tags 40*x* for different locations x. Teachings are not limited to a type of location various levels of location specificity may be associated with a tag 40 as desired by an operation.

In some embodiments, tagged refuse may be scanned for detection of hazardous material while being collected by scanning system 60 mounted on truck 10 (not expressly depicted). In some embodiments, tagged refuse 30 may be scanned at waste management facility 50 by scanning system 60.

In some embodiments, concealed hazardous material that may be hidden in plastic bags, boxes or other container means to prevent detection may be exposed to scanning system 60 by a device operable to crush, cut, open or break contents of refuse that may be packaged (not expressly depicted).

For scanning, in some embodiments, refuse 30 may be deposited onto scanning system 60 comprising conveyor belt 72. A tag reader may read tag 40 prior to and/or following and/or during scanning to correlate or identify refuse 40 to a respective truck 10 and/or to a route 130. Conveyor belt 72 may move refuse 30 disposed thereon to scanner 70 where materials in the refuse may be scanned. As described earlier, embodiments are not limited to system 1 as depicted having a conveyor belt mechanism and other systems and methods of scanning refuse 30 may be used such as but not limited to hand held scanners 70, scanners 70 loaded on front ends of trucks, scanners installed on refuse movement vehicles such as front-end loaders, bulldozers, or other specialized material handling vehicles.

In some embodiments, multiple scanning systems 60 and/or multiple scanners 70 of system 1 may achieve a scanning throughput rate to scan all refuse collected from large geographic location 140 (e.g., a city or town) in a reasonable timeframe. In some embodiments, multiple types of scanners 70 may be configured to test a variety of different hazardous materials. In some embodiments, throughput of scanning system 60 and scanner 70 may be in the range of tons/hr and may be up to about 1000 tons/day.

In some embodiments, scanning system 60 and scanner 70 may be operable to detect very small quantities of hazardous material 35. In some embodiments, scanning system 60 and scanner 70 may be operable to detect trace quantities of hazardous material 35. In some embodiments, scanner 70 may have a sensitivity of detection to detect microgram quantities of hazardous material 35. In some embodiments, scanner 70 may have a sensitivity of detection to detect picogram quantities of hazardous material 35. For example, detection of as little as picogram quantities of trace particulate materials used to make an explosive device in an explosive device manufacturing factory have been performed. Trace quantities of explosive residue were detected at various locations in the factory such as in foot prints of personnel working in the explosive factory when they walked outside the factory, shoe soles of people in the explosive factory, door handles in the explosive factory, fingerprints of workers on vehicles that they drove (for example on vehicle door handles, steering wheels). However, teachings recognize that the sensitivity of a scanner may be over a wide range and may be subject to factors such as instrument sensitivity. Teachings recognize that a variety of commercially available scanners may be used.

Data from scanner 70 may be used to determine the presence or absence of hazardous material 35. In some embodiments, scanner 70 may further identify hazardous material 35. In some embodiments, hazardous material 35 may be identified as a class of a CBRNE agent, a class of an industrial pollutant or a toxic waste or an illegal drug. In some embodiments, scanner 70 may determine the exact molecular composition of a CBRNE agent, an industrial pollutants or a toxic waste, and/or a street drug. In some embodiments, scanning system 60 may be operable to produce a signal when a hazardous material is detected.

Isolation system 75 may be then used to isolate refuse 30 detected to have hazardous material 35. Tag 40 associated with isolated refuse 30 may be read (again or for the first time) and sent to scanner 80 to confirm the presence of hazardous material 35. In some embodiments, scanner 80 may be operable to identify additional details about the nature of hazardous material 35.

Detection of hazardous material 35 may be communicated to waste management operations 100. Waste management operations 100 may coordinate a series of events to correlate identified hazardous material 35 to the source of its geo-location and to provide notification and/or evidence to authorities 90 to further investigate activities or individuals associated with the geo-location of hazardous material 35.

As described earlier, trucks 10 may transmit route 130 information to waste management operations 100 which is operable to receive information relating to various routes 130 taken by various trucks 10 using a receiving device. This information may be stored in a route database or a data archive. When waste management operations 100 receives data from waste management facility 50 regarding a positive detection of hazardous material 35 (and optionally identity or nature of detected hazardous material 35) and an associated tag 40 data, it may query a route database (e.g. by using computer software), to obtain information relating to respective route 130 taken by respective truck 10 which collected refuse 30 associated with tag 40 that was detected to have a hazardous material 35. In some embodiments, truck route 130 may be verified. Truck route 130 and data relating to the nature and type of hazardous material may be relayed to authorities 90. Accordingly, waste management operations 100 may be operable to geo-locate hazardous material 35 collected by one of a plurality of trucks 10 that collected a large amount of refuse 30 from large geographic area 140 to a small geographic area 150 which in some embodiments may be street address 151. According to some embodiments, information in tag 40 may describe the detail of a geo-location or a smaller geographic area.

FIG. 1B depicts geo-location of hazardous material 35 collected from large geographic area 140 to small geographic area 150 according to teachings of the present disclosure. Small geographic area 150 may be an area smaller than 140 and its size may be determined by the information of corresponding tag 40. For example, if tag 40 describes only truck route 130, then small area 150 would be route 130. If tag 40 describes a neighborhood, then small area 150 would be the neighborhood. If tag 40 describes a street, then small area 150 would be the street. If tag 40 describes a street address, then small area 150 would be a street address 151.

Authorities 90 may then investigate route 130 or smaller area thereon for activities relating to the detected hazardous material. Isolated refuse 30 detected to have hazardous substance 35 may be used as evidence by authorities 90 for investigation purposes.

Figure 2:
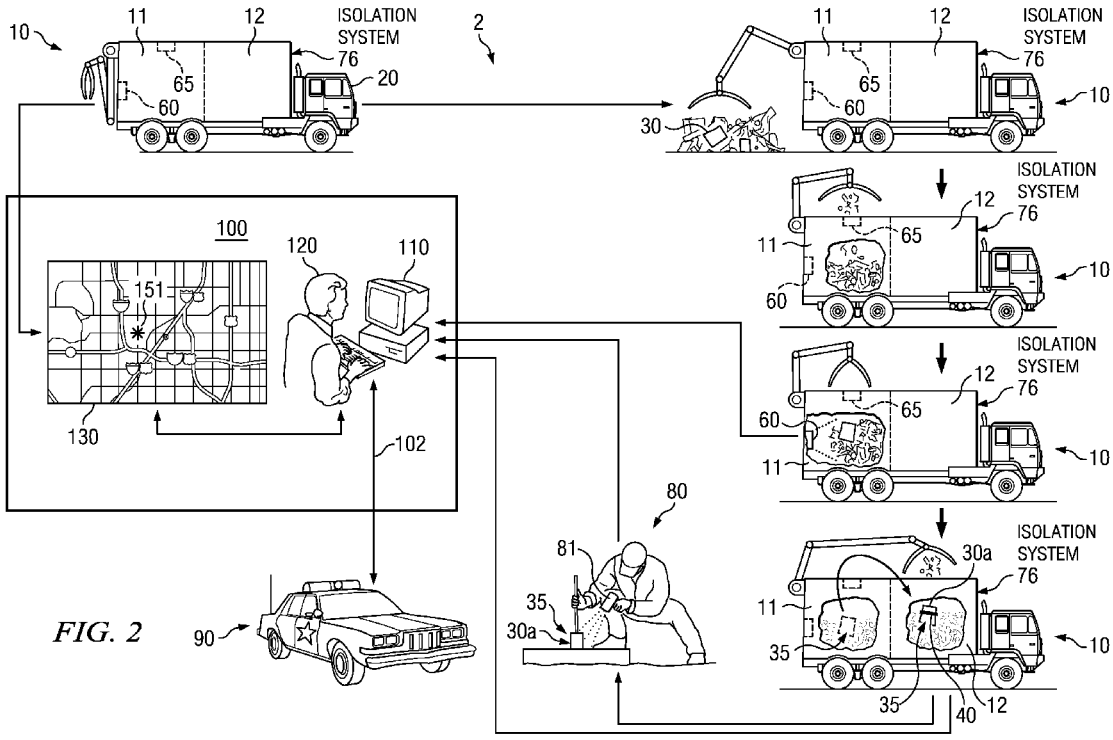
FIG. 2 illustrates another exemplary system operable to scan, detect and geo-locate a hazardous material in refuse, according to a specific example embodiment of the disclosure.

FIG. 2 illustrates an exemplary system 2, according to some embodiments of the disclosure, operable to scan large geographic region 140 (shown in FIG. 1B) to detect for the presence of one or more hazardous materials 35. Components of system 2 may be further operable to geo-locate the source of hazardous material 35 to a street address 151 (shown in FIG. 1B). Components of system 2 may be operable to identify a location or a facility at 151 that is the source of hazardous material 35. However, teachings recognize that the disclosure is not limited to system 2 as depicted and other alternative components, designs, including the presence of additional or fewer components may be used in accordance to the present teachings. Some components of system 2 may be similar to those of system 1 described above and accordingly may not be described in the same detail as described for system 1 above. These may include without limitation similarly labeled parts and components and reference may be made to sections above for details on similarly labeled components.

System 2 may comprise a plurality of vehicles operable to collect refuse such as but not limited to trucks 10, each truck 10 operable to collect refuse 30. Each truck 10 may have a geo-location system 20 operable to identify an address 151 at which refuse 30 may be picked up by a respective truck 10. Geo-location system 20 may be as described in sections above for system 1. Each truck 10 may have a scanning system 60 operable to scan collected refuse 30 from a large geographic area 140 and detect hazardous material 35 in collected refuse 30 collected from an address 151 in large geographic area 140. Address 151 may be a street address 151 as shown for example in FIG. 1B. In some embodiments, system 2 may be configured to scan refuse 30 for the presence of one or more hazardous materials 35 as the refuse 30 is being collected.

Scanning system 60 may comprise one or more scanners 70, operable to scan and detect one or more hazardous material 35. Scanning system 60 comprising scanner 70 may be located in or on truck 10. Teachings recognize that scanning system 60 may be located at a variety of locations on truck 10 and that teachings are not limited to the locations depicted in FIG. 2. Non-limiting examples may include without limitation hand held scanners 70, scanning systems or scanners located on front ends of trucks, scanners installed on refuse movement vehicles such as front-end loaders, bulldozers, or other specialized material handling vehicles. In non-limiting examples of system 2, scanning system 60 may comprise a conveyor belt mechanism or other mechanism to move collected refuse in the vicinity of scanning system 60 to enable detection. Scanning system 60 and scanners 70 may be similar to those described in sections above for system 1.

In some embodiments, system 2 may further comprise an isolation system 76 operable to isolate refuse detected to have hazardous material 35. Isolation system 76 may comprise a chamber in truck 10 where refuse 30 detected to have a hazardous material 35 may be transported to and retained and a device to move refuse 30 detected to have a hazardous material 35 to the chamber. Teachings recognize that other configurations of isolation system 76 may be used in truck 10.

In some embodiments, isolation system 76 may comprise a device to attach tag 40 to refuse 30 detected to have hazardous material 35. Tag 40 may have information corresponding to street address 151 from which refuse 30 detected to have hazardous material 35 was collected. In some embodiments, isolated refuse containing hazardous material may be used later for evidentiary purposes by authorities. Accordingly, isolated refuse may be tagged with tag 40 for identification purposes and for correlation to street address 151. Teachings recognize that present system 1 encompasses embodiments where tag 40 may not be attached to isolated refuse.

In some embodiments, a truck 10 of system 2 may further comprise a device 65 operable to expose contents of a concealed hazardous material prior to scanning Accordingly, in some embodiments, hazardous material concealed in a plastic bag, a box or a container means to prevent detection may be detected by system 2. In some embodiments, device 65 may be operable to crush, cut, open or break the contents of concealed hazardous material 35 that may be concealed in collected refuse 30 inside a plastic bag, a box or other container means to prevent detection. In some embodiments, device 65 may comprise a manual operator cutting or opening concealed trash (not depicted).

System 2 may comprise scanner 80 operable to rescan and confirm detection of hazardous material 35. In some embodiments, scanner 80 may comprise a human operator and a scanner 81 as shown. In some embodiments, scanner 80 may comprise an automated scanner operable to scan isolated refuse detected to have hazardous material 35 (not expressly depicted). An automated scanner may be located in truck 10 or may be located in a waste management facility 50 (not depicted). Scanner 80 may comprise one or more scanner systems 60 and scanner 70 as described in sections above.

System 2 may comprise communication devices to communicate a variety of information to and from data center 100. Information may be transmitted from and received by truck 10 and data center 100 by these communication devices (not depicted).

System 2 may comprise data center 100 (e.g., such as but not limited to waste management operations and/or a law enforcement data center) which may comprise without limitation one or more of the following components, a device to receive and a storage means (e.g., a database) to store, various routes 130 taken by various trucks 10; various addresses 151 from which various trucks 10 pick up garbage; a means to communicate with a truck 10 and/or a waste management facility 50 (not depicted) to receive/transmit data such as a positive detection of hazardous material 35, and/or no detection of hazardous material, and/or isolation of detected hazardous material 35; at least a means to query (e.g., a software) a storage means (such as a database) about a respective route 130 taken by a respective truck 10 and respective addresses 151 from which garbage is picked up by a respective truck 10; at least a means to correlate (e.g., software) refuse 30 detected to have hazardous material 35 by reading an associated tag 40 to a truck 10; means to verify an address 151 and/or truck route 130; personnel to operate, read, interpret and respond to various inputs received; means to send information (e.g., notification system 102) about detected hazardous material and associate route information to authorities 90 (e.g., law enforcement personnel, environmental enforcement personnel, drug enforcement personnel); and a means to communicate with and provide additional route or hazardous material information to authorities 90.

Accordingly, data center 100 may comprise one or more of the following devices that have not been expressly depicted including: one or more computers, personnel, storage devices, input devices, communication devices, devices to receive information, devices to send information, one or more process control programs, one or more data input programs, one or more data output readers, software to analyze information received, a network interface (or network connectivity), printing devices, visual graphics display devices (such as a video wall). In some embodiments, system 2 may be started, shut down and controlled in manually, automatically or by a combination of automated and manual steps. Manual control may be by human operators.

System 2 may further comprise a notification system 102 operable to notify authorities 90 (e.g., law enforcement personnel such as police, drug enforcement authorities, Type I Bomb Squads, environmental regulation authorities) about detection of hazardous material 35 in refuse 30. Notification system 102 may be further operable to provide authorities 90 an address 151 from where refuse 30 detected to have hazardous material 35 was collected from. Notification system 102 may be mediated through data center 100 as depicted in FIG. 2 or directly from truck 10 to authorities 90 (not depicted). In some embodiments, one or more notification system 102 may be comprised in system 2, and may be operable to provide notification following detection of hazardous material 35, following detection and isolation of hazardous material 35 and/or following re-scanning of isolated material 35 to confirm detection of hazardous material 35.

In an exemplary embodiment, system 2 may function by a plurality of trucks 10 driving a plurality of routes 130, covering a large geographic area 140, to collect refuse 30 at various locations (e.g., addresses 151) on each route 130. Routes 130 taken by each truck 10 may be recorded and stored by geo-location system 20 including addresses 151. Routes 130 and addresses 151 taken by each truck 10 may also be transmitted and stored in a database comprised in data center 100.

Refuse 30 may be scanned for detection of hazardous material 35 while being collected by scanning system 60 mounted on truck 10. Scanning system 60 mounted in or on truck 10 may scan refuse as it is being collected and deposited into chamber 11 of truck 10.

In some embodiments, concealed hazardous material that may be hidden in plastic bags, boxes or other container means to prevent detection may be exposed to scanning system 60 by a device 65 operable to crush, cut, open or break contents of refuse that may be packaged prior to being scanned by scanning system 60.

For scanning, in some embodiments, refuse 30 may be deposited onto scanning system 60 comprising a conveyor belt (not depicted) prior to scanning. In some embodiments, multiple scanning systems 60 and/or multiple scanners 70 of system 2 may achieve a scanning throughput rate to scan all refuse collected from an address 151 in a reasonable timeframe. In some embodiments, this may be prior to picking up garbage from the next address 151. In some embodiments, multiple types of scanners 70 may be configured to test a variety of different hazardous materials. In some embodiments, throughput of scanning system 60 and scanner 70 may be in the range of tons/hr and may be up to about 1000 tons/day.

In some embodiments, scanning system 60 and scanner 70 may be operable to detect very small quantities of hazardous material 35. In some embodiments, scanning system 60 and scanner 70 may be operable to detect trace quantities of hazardous material 35. In some embodiments, scanner 70 may have a sensitivity of detection to detect microgram quantities of hazardous material 35. In some embodiments, scanner 70 may have a sensitivity of detection to detect picogram quantities of hazardous material 35. However, teachings recognize that the sensitivity of a scanner may be a wide range and may be subject to factors such as instrument sensitivity.

Data from scanner 70 may be used to determine the presence or absence of hazardous material 35. In some embodiments, scanner 70 may further identify hazardous material 35. In some embodiments, hazardous material 35 may be identified as a class of a CBRNE agent, a class of an industrial pollutant or a toxic waste or an illegal drug. In some embodiments, scanner 70 may determine the exact molecular composition of a CBRNE agent, an industrial pollutants or a toxic waste, and/or a street drug. In some embodiments, scanning system 60 may be operable to produce a signal when a hazardous material is detected. This signal may be conveyed to notification system 102.

Isolation system 76 may be then used to isolate refuse 30 detected to have hazardous material 35. Isolation system 76 may comprise chamber 12 and a device to transfer refuse 30 detected to have hazardous material 35 into chamber 12 of truck 10.

In some embodiments, refuse 30 detected to have hazardous material 35 may be tagged by tag 40. Each tag 40 may be operable to identify a respective truck 10 and the refuse 30 that was picked up by the respective truck. In some embodiments, each tag 40 may be operable to identify refuse with a respective location, such as street address 151, and/or route 130 from where it was picked up. Accordingly, in some embodiments, refuse 30 collected from a first street address 151*a* may be tagged with a first tag 40*a*, refuse 30 collected from a second street address 151*b* may be tagged with a second tag 40*b* and the process repeated with different tags 40*x* for different locations x. Tagging of isolated refuse 30 detected to have a hazardous material 35 may be used for identification and evidence purposes later.

Isolated refuse 30 may be sent to scanner 80 to confirm the presence of hazardous material 35. In some embodiments, scanner 80 may be operable to identify additional details about the nature of hazardous material 35.

Confirmation of hazardous material 35 may be communicated to data center 100. Data center 100 may coordinate a series of events to correlate identified hazardous material 35 to the source of its geo-location and to provide notification and/or evidence to authorities 90 to further investigate activities or individuals associated with the geo-location 151 of hazardous material 35.

As described earlier, trucks 10 may transmit route 130 information and/or address 151 information to data center 100 which is operable to receive information relating to various routes 130 and various addresses 151 taken by a plurality of trucks 10 using a receiving device. This information may be stored in a route database or a data archive. When data center 100 receives data from truck 10 regarding a positive detection of hazardous material 35 (and optionally identity or nature of detected hazardous material 35), it may query a route database (e.g. by using computer software), to obtain and/or confirm information relating to respective route 130 and address 151 of respective truck 10 which collected refuse 30 that was detected to have a hazardous material 35. Confirmed truck route 130 and address 151 and data relating to the nature and type of hazardous material may be relayed to authorities 90. Accordingly, data center 100 may be operable to geo-locate hazardous material 35 collected by a plurality of trucks 10 that collected a large amount of refuse 30 from large geographic area 140 to a small geographic area 150 which in some embodiments may be street address 151 and notify authorities 90.

In some embodiments, teachings of the present disclosure (including system 1 and system 2 described above and methods described later) may enable detection of trace particulates of hazardous material 35 generated during manufacture of explosives, chemical warfare agents, biological warfare agents and/or radioactive agents. In contrast to technologies and devices that focus on detecting terrorist devices after they are brought into public places and are close to causing devastating consequences, systems and methods of the present disclosure, according to some embodiments, are designed to scan for and detect hazardous materials associated with terrorist devices and to further geo-locate a geographic area where the hazardous material originated from thereby geo-locating an individual or a facility that may be developing or manufacturing a terrorist device.

In contrast to technologies that may be able to detect environmentally hazardous materials in waterways, the present systems and methods allow detection of improperly disposed environmentally hazardous materials 35 in garbage and to further geo-locate a facility or an address associated with the improper disposing activity and may be used to determine a source of or one or more individuals associated with an improper refuse disposing activity. In some embodiments, the present systems and methods may prevent toxic chemicals, such as but no limited to chemicals in solvents, paints, batteries, industrial pollutants, bio-hazardous wastes that may be disposed in normal refuse from eventually ending up in land fills and waterways, by geo-locating an address where the disposal is happening and implementing measures to prevent or stop further disposal of hazardous material into garbage.

While systems and methods may exist to detect illegal drugs in water bodies the present systems and methods are allow geo-location of the source of drugs to specific smaller geographic locations (e.g. street addresses in some example embodiments). Detection of illegal drugs as hazardous material 35, according to the present disclosure, may be used to identify and locate geographic locations 140 and/or 151 and individuals associated to the locations that possess, manufacture or sell illegal street drugs. Accordingly, systems and methods of the disclosure may be useful in preventing or reducing illegal drug-related activities.

Figure 3A:
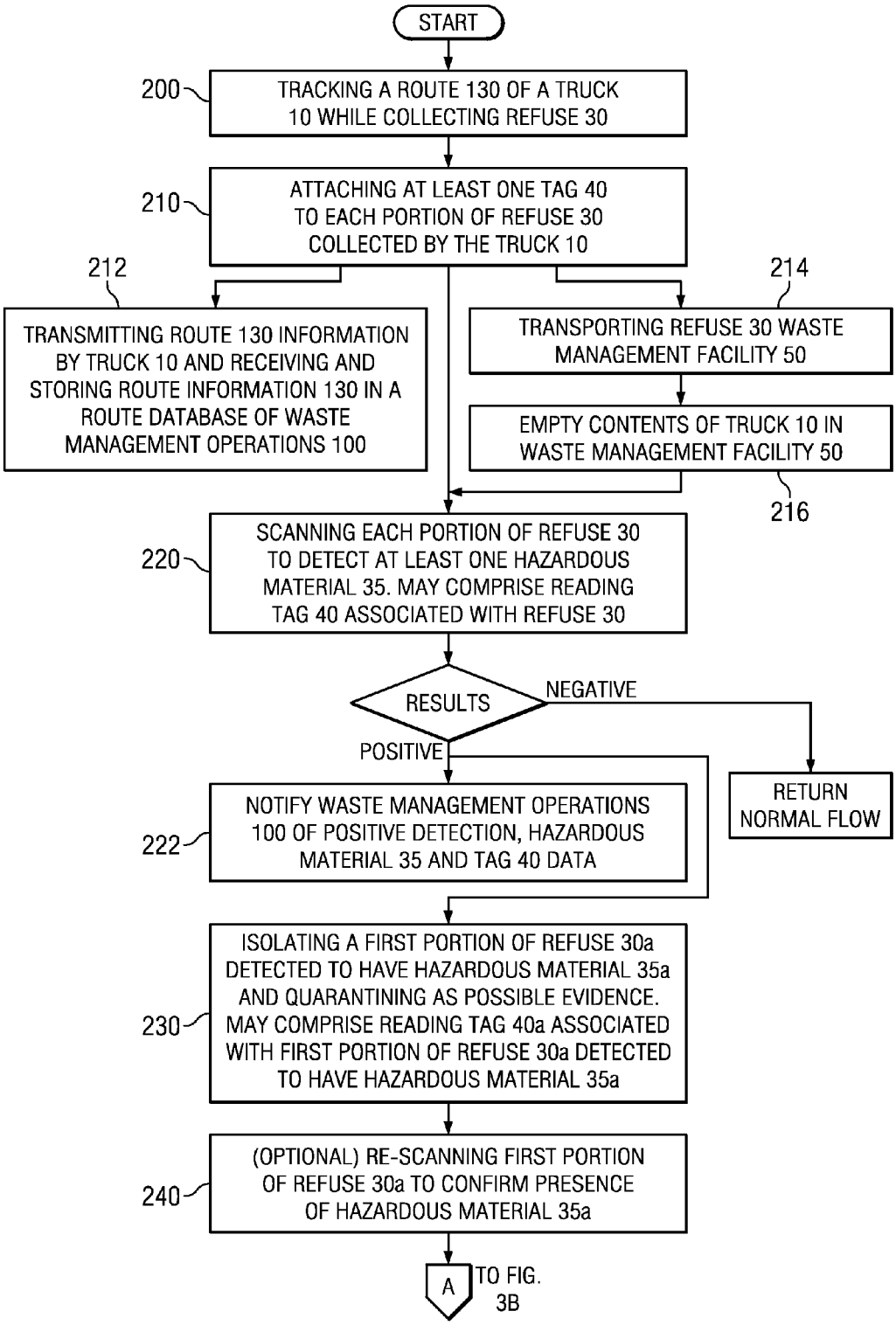
FIGS. 3A and 3B illustrate an exemplary method flow operable to detect and geo-locate a hazardous material in refuse, according to a specific example embodiment of the disclosure.
Figure 3B:
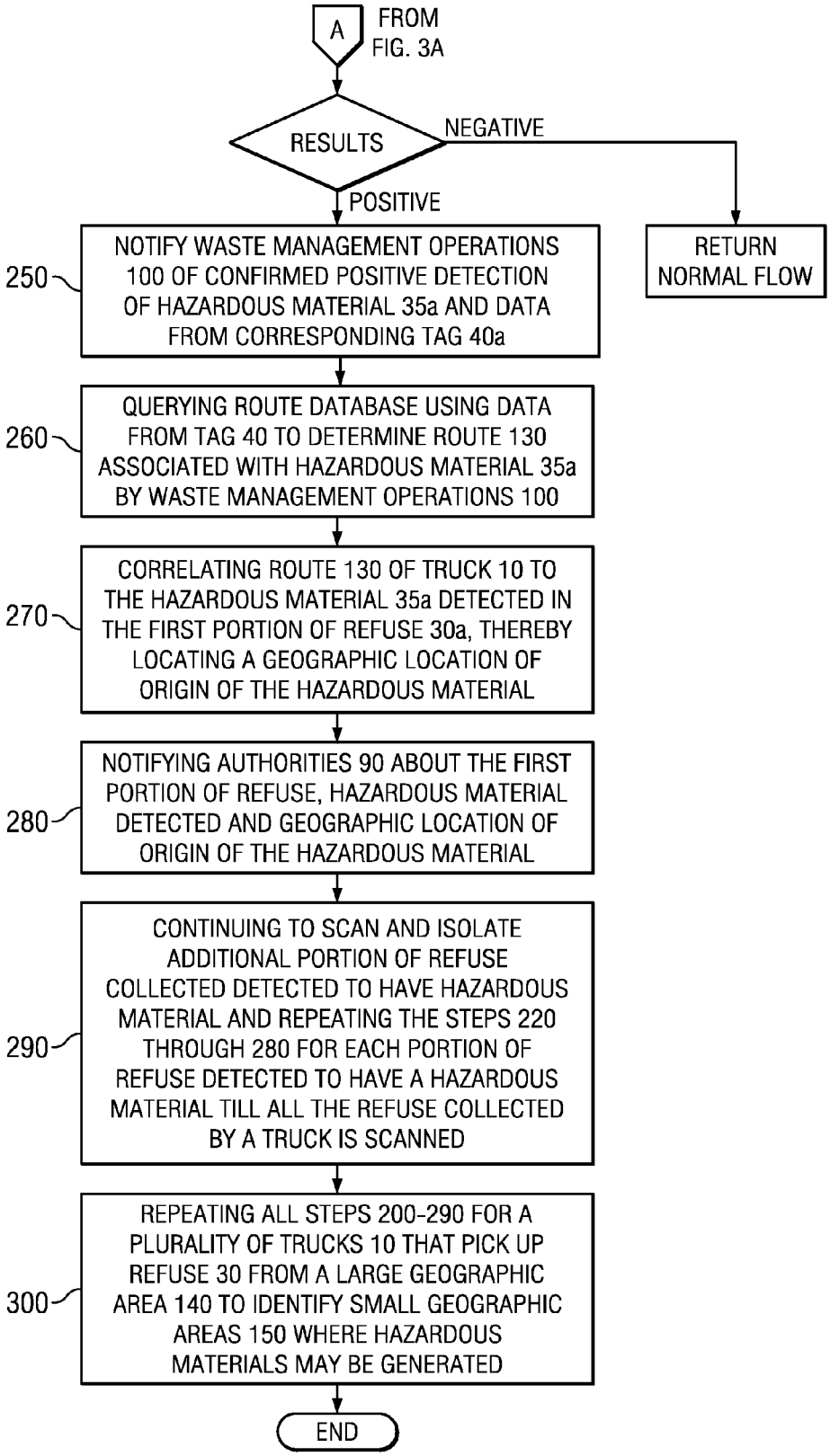

Methods to scan for and detect hazardous substances that may be generated in a large geographic area 140 are also described herein. In some embodiments, methods according to the present disclosure may be further operable to geo-locate a facility where hazardous materials may be generated. An exemplary method for detecting hazardous material in refuse and for identifying a geographic location of origin of refuse detected to have hazardous material is shown in FIGS. 3A and 3B and may comprise step 200 comprising tracking a route 130 of truck 10 while collecting refuse 30 by means of a geo-locating system 20. Step 210 may comprise attaching at least one tag 40 to each portion of refuse 30 collected by truck 10. Tag 40 may have data associated with route 130 and truck 10 and may include information such as but not limited to, stops and duration of stops during refuse pick up, data on trash collected, location of trash collected such as a suburb, a neighborhood, a street, a street addresses and any combination thereof. Tags may be attached manually or by a machine operable to attach a tag.

Step 212 may comprise transmitting information by truck 20 regarding its route 130 to waste management operations 100 where the information is received and stored in a route database that may have route information from a plurality of trucks that may pick up refuse 30 from a large geographic area, such as 140.

Step 220 may comprise scanning each portion of refuse 30 collected to detect at least one hazardous material 35. In some embodiments, scanning may be performed on a truck 10 using scanners 70 (and/or scanning system 60) mounted on truck 10. In other embodiments, prior to Step 220, tagged refuse 30 may be transported in step 214 to a waste management facility 50, such as but not limited to, a waste collection center, a landfill or a transfer station. In step 216, truck 10 may empty its contents in waste management facility 50 prior to scanning of the tagged refuse 30.

If hazardous material 35 is detected in scanning Step 220, step 220 may further comprise reading tag 40 associated with refuse 30 detected to have hazardous material 35. If hazardous material 35 is detected in step 220, step 222 may comprise notifying waste management operations 100 of a positive detection and providing information regarding tag 40 data to waste management operations 100.

At step 230, refuse detected to have hazardous material 35 may be isolated as a first portion of refuse 30*a* detected to have a hazardous material 35*a*. Step 230 may comprise reading tag 40*a* associated with first portion of refuse 30*a* detected to have hazardous material 35*a*. In step 230, refuse 30*a* detected to have hazardous material 35*a* may be further quarantined as evidence and may later be provided to authorities 90.

Step 240 may, in some embodiments, comprise an optional step comprising re-scanning first portion of refuse 30*a* to confirm presence of hazardous material 35*a*. Step 250 comprises notifying waste management operations 100 of a confirmed positive detection of hazardous material 35*a* and data from corresponding tag 40 (or 40*a*) related to refuse 30 (or 30*a*) that comprises hazardous material 35*a*.

At step 260, waste management operations 100 may query a route database using data from tag 40 (obtained from steps 220 and/or 230 that comprise reading tag 40 (or 40*a*)). Step 270 may comprise correlating first portion of refuse 30 (30*a*) detected to have hazardous material 35 (35*a*) with route 130 of truck 10 that collected the first portion of refuse 30*a*, thereby locating a geographic location of origin of hazardous material 35*a*.

Step 280 may comprise notifying authorities 90 about the first portion of refuse 30*a*, hazardous material 35*a* detected and the geographic location of origin of the hazardous material 35. The method continues in step 290 by continuing scanning other portions of refuse 30 collected and continuing to isolate additional portion of refuse 30 detected to have hazardous material by repeating steps 220 through 280 for each portion of refuse 30 detected to have hazardous material 35 till all refuse collected by a truck 10 has been scanned.

Step 300 may comprise repeating all steps 200-290 for a plurality of trucks 10 that pick up refuse 30 from large geographic area 140 to identify one or more small geographic areas 140 where hazardous materials may be generated. In some embodiments, a method of the disclosure may be operable to narrow the geo-location of origin of hazardous material 35 to an area of about 6 sq miles or lesser. In some embodiments a method of the disclosure may be operable to scan refuse collected from a 400 sq mile area and narrow the geo-location of origin of hazardous material 35 to an area of about 6 sq miles or lesser. In some embodiments a method of the disclosure may be operable to narrow the geo-location of origin of hazardous material 35 to a street address 151.

In some embodiments a method comprising steps 200-300 may be performed on system 1 of the disclosure.

Figure 4:
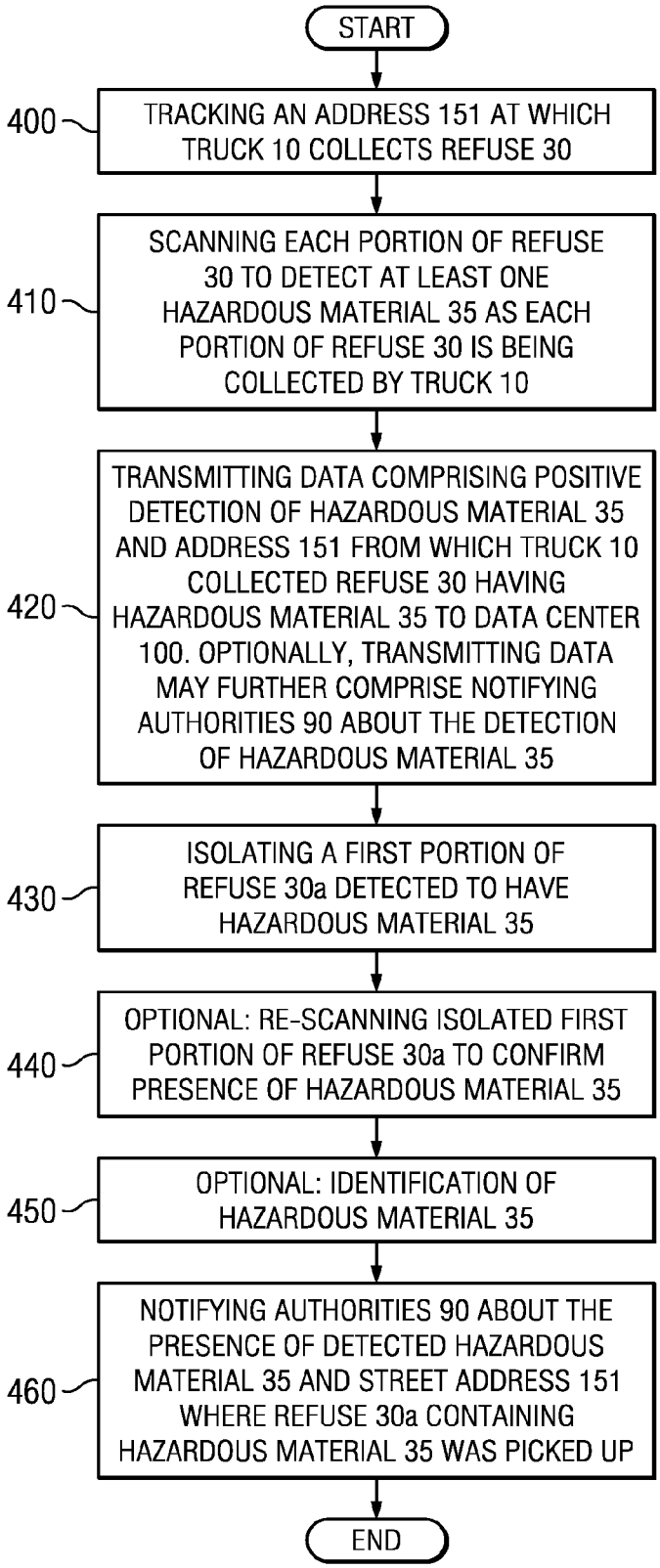
FIG. 4 illustrates an exemplary method flow operable to detect and geo-locate a hazardous material in refuse, according to a specific example embodiment of the disclosure.

In some embodiments, another method according to the disclosure for detecting hazardous material 35 in refuse 30 and for identifying a geographic location of origin of refuse detected to have hazardous material may be depicted in FIG. 4 and may comprise step 400 which may comprise tracking an address at which truck 10 collects refuse 30. Step 410 may comprise scanning each portion of refuse 30 to detect at least one hazardous material 35. In some embodiments, refuse 30 may be scanned as each portion of refuse 30 is being collected by truck 10. In some embodiment, scanner 60 may be located on or in each truck 10. Step 410 may also comprise exposing concealed hazardous material comprising using device 65 to open and expose concealed hazardous material 35 to scanner system 60.

Step 420 may comprise transmitting data comprising positive detection of hazardous material 35 and address 151 from which truck 10 collected refuse 30 having hazardous material 35 to data center 100. In some embodiments, data center 100 may comprise waste management operations 100. In some embodiments, data center 100 may comprise a law enforcement authority database. At step 420, in some embodiments, transmitting data may further comprise notifying authorities 90 about the detection of hazardous material 35.

In some embodiments, the method may also comprise step 430 comprising isolating a first portion of refuse detected to have hazardous material 35. Isolated first portion of refuse detected to have hazardous material 35 may be used by authorities 90 as evidence or may be used to re-confirm presence or detect identity of hazardous material 35. Step 440 comprising re-scanning to confirm presence of hazardous material 35 may, in some embodiments, be performed in or on truck 10 using scanning system 80 in step 414. Step 440 may be performed at another site such as but not limited to a waste management facility 50.

In some embodiments, Step 440 comprising reconfirmation of presence of hazardous material 35 may be performed at waste management facility 50 and may comprise a step where the isolated refuse is transported to waste management facility 50 prior to re-scanning (step not depicted). In such embodiments, isolated refuse may be tagged with a tag 40 comprising street address 151 from where isolated refuse was collected (step not depicted).

Step 450 may be performed to optionally identify hazardous material 35. Step 460 may comprise an optional step of notifying authorities 90 about the presence of detected hazardous material 35 and may include notifying authorities the street address 151 where refuse containing hazardous material 35 was picked up.

Step 470 (not depicted) may comprise repeating all steps 400-460 for a plurality of trucks 10 that pick up refuse 30 from large geographic area 140 to identify one or more small geographic areas 151 where hazardous material 35 may be generated.

In some embodiments, steps 400-470 may be performed on system 2 of the disclosure.

In some embodiments, a method of the disclosure may have a sensitivity to detect picogram quantities of a hazardous material. In some embodiments, a method of the disclosure may have a sensitivity to detect microgram quantities of a hazardous material. In some embodiments, hazardous material 35 present at low vapor pressures and/or in small or trace quantities may be detected by the present methods. In some embodiments, a method may be operable to scan refuse 30 at a throughput of one thousand (1000) tons/day or more.

As will be understood by those skilled in the art who have the benefit of the instant disclosure, other equivalent or alternative devices, methods, and systems for detecting hazardous materials of interest may be envisioned without departing from the description contained herein. Accordingly, the manner of carrying out the disclosure as shown and described is to be construed as illustrative only.

Persons skilled in the art may make various changes in the shape, size, number, and/or arrangement of parts of system 1 or system 2 without departing from the scope of the instant disclosure. For example, a tag 40 may have information regarding a variety of geo-location specifics and a truck 10; a scanning system 60 may have a variety of configurations for moving refuse to scanner 70 where it may be scanned; scanning system 60 may be at a variety of locations in systems 1 and 2. Scanning system 60 may be assembled to comprise a variety of COTS scanners 70 for the detection of one or more analytes (hazardous materials) of interest as described herein. In addition, the size and scale of a system may be adapted, scaled up or down to fit into any existing sampling, detection, screening device and/or COTS sensor and/or for any amount of refuse that may be collected. Components such as geolocators, tag attachment devices, and/or scanners may be configured and arranged to be reusable, disposable, serviceable, interchangeable and/or replaceable.

What is claimed is:

1. A system for detecting hazardous material in refuse and for identifying geographic location of origin of refuse detected to have hazardous material comprising:

a plurality of trucks, each truck operable to collect refuse;

each truck having a geo-location system operable to track and store routes taken by each truck;

each truck having a device for attaching at least one tag to collected refuse, each tag operable to associate collected refuse to a respective truck;

a scanning system operable to scan collected refuse and to detect hazardous material in collected refuse;

an isolation system operable to separate and isolate refuse detected to have hazardous material; and an identification system operable to read a tag attached to refuse detected to have hazardous material and identify a truck that collected refuse detected to have hazardous material, the identification system further having the ability to obtain a route taken by the truck that collected refuse detected to have hazardous material.

2. The system of claim 1, further comprising a notification system operable to notify authorities about refuse detected to have hazardous material and the route taken by the truck that collected refuse detected to have hazardous material, thereby identifying a geographic location of origin of refuse detected to have hazardous material.

3. The system of claim 1, wherein hazardous material may comprise an explosive agent, a component of an explosive device, a chemical, a chemical warfare agent, a radioactive material, a biological agent, a bio-terrorist agent, a toxic chemical, a pollutant, a solvent, a paint, a bio-hazardous material or combinations thereof.

4. The system of claim 1, wherein the device for attaching at least one tag is further operable to attach a tag on each bag of refuse collected.

5. The system of claim 4, wherein the tag is further operable to associate each bag of collected refuse to a respective geographic location.

6. The system of claim 4, wherein the tag is further operable to associate each bag of collected refuse to a respective street address.

7. The system of claim 1 wherein the tag is selected from a group consisting of a geo-location tag, an radio frequency (RF) tag, a dye, a barcode, a paint, a chemical, and combinations thereof.

8. The system of claim 1, wherein the scanning system is further operable to identify hazardous material detected.

9. The system of claim 1, wherein the scanning system is located at a waste management facility.

10. The system of claim 1, wherein the scanning system further comprises a device to expose concealed refuse having hazardous material prior to scanning.

11. The system of claim 1, wherein the scanning system may comprise a scanner comprising a spectrophotometer, an X-ray imager, a imaging system, an electrochemical systems, a surface acoustic wave sensor (SAWS), a mass sensors, an optical sensor, a Compton imager, a stand-off radiation detection system (SORDS), a photon detector, a Geiger counter, a scintillation counter, a biological detection system, a data collection module, a data processing module, a module to detect and subtract background noise, a module operable to store collected data, an identification module, an output module, an alarm module or any combinations thereof.

12. A system for detecting hazardous material in refuse and for identifying geographic location of origin of refuse detected to have hazardous material comprising:

a plurality of trucks, each truck operable to collect refuse;

each truck having a geo-location system operable to identify a plurality of addresses at which refuse is collected from by a respective truck;

each truck having a scanning system operable to scan and detect hazardous material in collected refuse; and a communication device operable to transmit information relating to detection of hazardous material and a respective address at which the refuse detected to have hazardous material was collected up from to a data center, thereby identifying a geographic location of origin of refuse detected to have hazardous material.

13. The system of claim 12 further comprising a notification system operable to notify authorities about detection of hazardous material in refuse, the notification system further operable to provide authorities the respective address at which the refuse detected to have hazardous material was collected from.

14. The system of claim 12 further comprising an isolation system operable to isolate refuse detected to have hazardous material.

15. The system of claim 12, wherein the scanning system comprises one or more scanners.

16. The system of claim 12, the scanning system further operable to identify the hazardous material detected.

17. The system of claim 12, further comprising a device to expose contents of a concealed hazardous material prior to scanning.

18. A method for detecting hazardous material in refuse and for identifying a geographic location of origin of refuse detected to have hazardous material comprising:

a) tracking a route of a truck while collecting refuse to obtain a truck route information;

b) transmitting the truck route information to a route database;

c) attaching at least one tag to each portion of refuse collected by the truck;

d) scanning each portion of refuse to detect at least one hazardous material;

e) isolating a first portion of refuse detected to have a hazardous material;

f) reading a tag attached to the first portion of refuse detected to have the hazardous material to obtain tag information and isolating the first portion of refuse;

g) querying the route database with tag information and determining the route of the truck that collected the first portion of refuse;

h) correlating the route of the truck to the hazardous material detected in the first portion of refuse, thereby locating a geographic location of origin of the hazardous material and i) continuing to isolate additional portion of refuse collected detected to have hazardous material and repeating the steps of d) through i) for each portion of refuse detected to have a hazardous material till all the refuse collected by the truck is scanned.

19. The method of claim 18 further comprising notifying authorities about the first portion of refuse, the hazardous material detected and the geographic location of origin of the hazardous material.

20. The method of claim 18, wherein the tracking may comprise tracking and storing data relating to stops and durations of stops of the truck.

21. The method of claim 18, wherein the tracking may comprise noting a street address of each stop where the truck picks up refuse.

22. The method of claim 18, wherein attaching a tag may comprise attaching a geo-location tag, an RF tag, a dye, a mark, a stamp, a barcode, a paint, a chemical or combinations thereof to each portion of refuse collected.

23. The method of claim 18, further comprising re-scanning a first portion of refuse detected to have a hazardous material to confirm the presence of the hazardous material in the isolated first portion of refuse.

24. The method of claim 18, further comprising repeating the steps of claim a) through i) for a plurality of trucks that pick up refuse from a large geographic area, thereby scanning refuse from the large geographic area to geo-locate one or more small geographic areas of origin of hazardous material.

25. A method for detecting hazardous material in refuse and for identifying a geographic location of origin of refuse detected to have hazardous material comprising:

a) attaching at least one tag to collected refuse, each tag operable to associate tag to a respective truck;

b) tracking an address at which a truck collects refuse;

c) scanning each portion of refuse to detect at least one hazardous material as each portion of refuse is being collected;

d) isolating refuse detected to have hazardous material; and e) transmitting data comprising positive detection of a hazardous material and the address from which the truck collected refuse having the hazardous material to a data center.

26. The method of claim 25, wherein transmitting data further comprises notifying authorities about the hazardous material detected.

27. The method of claim 25, further comprising:

isolating a first portion of refuse detected to have a hazardous material.

28. The method of claim 27, further comprising:

rescanning the first portion of refuse detected to have a hazardous material.

* * * * *